US011116272B2

(12) United States Patent
Schmidt et al.

(10) Patent No.: US 11,116,272 B2
(45) Date of Patent: Sep. 14, 2021

(54) ADJUSTABLE PROTECTIVE HELMET JAW FLAP

(71) Applicant: Rawlings Sporting Goods Company, Inc., St. Louis, MO (US)

(72) Inventors: Marc Schmidt, Weldon Spring, MO (US); Mitch Hinrichsen, St. Louis, MO (US); Zach Runzo, St. Louis, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 94 days.

(21) Appl. No.: 16/679,492

(22) Filed: Nov. 11, 2019

(65) Prior Publication Data

US 2020/0146386 A1 May 14, 2020

Related U.S. Application Data

(60) Provisional application No. 62/758,811, filed on Nov. 12, 2018.

(51) Int. Cl.
*A42B 3/20* (2006.01)

(52) U.S. Cl.
CPC ..... *A42B 3/20* (2013.01)

(58) Field of Classification Search
CPC .. A42B 3/18; A42B 3/324; A42B 3/20; A42B 3/205
See application file for complete search history.

(56) References Cited

U.S. PATENT DOCUMENTS 2,785,465 A * 3/1957 Gaidos ..... F41G 1/26 42/137
2,908,911 A * 10/1959 Sowle ..... A42B 3/20 2/9
2,944,263 A * 7/1960 Rayburn ..... A42B 3/20 2/9
2,954,564 A * 10/1960 Sowle ..... A42B 3/20 2/9
3,216,023 A * 11/1965 Morgan ..... A42B 3/08 2/9
4,677,694 A * 7/1987 Crow ..... A42B 3/20 2/10
4,885,806 A * 12/1989 Heller ..... A42B 3/20 2/423
D548,893 S * 8/2007 Hedge ..... D29/122
9,763,488 B2 * 9/2017 Bologna ..... A42B 3/128

* cited by examiner

*Primary Examiner* — Tajash D Patel
(74) *Attorney, Agent, or Firm* — Husch Blackwell LLP

(57) ABSTRACT

An adjustable jaw flap is provided that may be selectively attachable with the ear flap of a batter's helmet used in batted ball sports such as baseball or softball. The jaw flap may include each of an adaptor member and a flap member. The adaptor member may be attached to the batter's helmet at or near the helmet's ear flap. The flap member may be attached to the adaptor member at its lower end by a pin. An interior portion of the flap member preferably includes male attachment points that may be selectively attachable with female attachment points found at the upper portion of the adaptor member's exterior. When the flap member is rotated, more or fewer attachment points may be selectively engaged with one another, thus allowing a user to adjust the relative position of the jaw flap.

9 Claims, 7 Drawing Sheets

ADJUSTABLE PROTECTIVE HELMET JAW FLAP

CROSS-REFERENCE TO RELATED APPLICATIONS

This application claims priority to U.S. Provisional Patent Application Ser. No. 62/758,811, filed on Nov. 12, 2018, entitled "ADJUSTABLE PROTECTIVE HELMET JAW FLAP,", the entire disclosure of which is incorporated herein by reference.

FIELD OF INVENTION

The present invention relates generally to protective athletic gear, and more particularly to an adjustable jaw flap for protective helmets worn by batters in batted ball sports such as baseball, softball, and the like.

BACKGROUND OF INVENTION

Softball and baseball batters wear protective helmets during organized competition. When batters assume the batting stance in either sport, the batter's left or right side substantially faces the pitcher, thus leaving that side of his or her face facing the pitcher exposed to the path of oncoming pitched balls. At high levels, baseball pitchers can throw fastballs at speeds exceeding 90 MPH and at times greater than 100 MPH. This sort of velocity leaves little time for even the most skilled batters from avoiding the path of a pitched ball traveling toward the batter's head. As has been seen time and time again across all levels of baseball and softball, the impact of such a pitched ball striking a batter's face can cause a cheekbone, jawbone, and/or eye socket fracture, as well as other injuries. This can require extensive reconstructive surgery and likely sideline the player during the reconstructive and healing processes, or even end his or her career.

As such, high level baseball and softball players have begun utilizing a protective jaw flap attached to their batting helmet. The protective flap, commonly known as a C-flap, extends forwardly from an ear flap of the helmet such that it overlaps the cheekbone and jaw on a side of the batter's face. The protective flap has an upper edge spaced below the conventional visor extending forwardly from the helmet, leaving an open and unobstructed region between the visor and the protective flap for the batter's vision. This protective flap is typically releasably attachable to an existing batting helmet, though in alternative embodiments it may be integrally formed with the helmet.

Such a protective flap known in the art is either affixed to the ear protective panel of an existing helmet or formed integrally with and extending from the ear panel. In either event, the protective flap typically extends forwardly from the ear panel to lie alongside the cheekbone and jaw of the wearer. The upper edge of the protective flap is ideally located below the helmet's visor at distance less than the diameter of a baseball or softball (depending on the sport for which the helmet is designed), and the lower edge of the protective flap ideally substantially extends along the lower line of the batter's jaw. The protective flap ideally extends forwardly toward the batter's nose. The inner side of the protective flap is padded with a material which absorbs or dissipates the sudden impact caused by an oncoming ball. Existing protective flaps thus protect the cheekbone, jawbone, and nose from direct contact by an oncoming ball.

However, existing protective jaw flaps such as the C-flap are not adjustable. This can be problematic for batters who find the upper edge of the flap to obstruct their line of vision. Alternatively, some batters would prefer to have a smaller window between the visor and the upper line of the protective flap. The batter may thereby create a "tunnel vision" of sorts and further feel more comfortable that his or her face is well protected. In any case, batters have certain preferences when it comes to the positioning and comfort of helmet accessories. As such, it would be beneficial to provide some degree of adjustability to existing protective jaw flaps already used in the batted ball sports.

SUMMARY OF THE INVENTION

The invention disclosed herein improves upon the protective helmet jaw flaps currently used in amateur and professional baseball and softball. More particularly, the improved jaw flap hereof is pivotally adjustable so that a batter may adjust the protective jaw flap to a comfortable and effective position.

In the present invention, this objective is realized by providing a two-part adjustable protective helmet jaw flap. The first part of the jaw flap hereof is an adaptor member that may be configured to attach to known structures that exist on the earflaps of batting helmets. In a preferred embodiment, the adaptor member includes three apertures that align with apertures located on a helmet's earflap. A bolt, or other rod, may be extended through the apertures of the adaptor member and the helmet's earflap to semi-permanently attach the adaptor member to the helmet flap. After the helmet flap is adjusted in the manner described below, the adaptor member preferably stays in place relative to the helmet's earflap.

An exterior portion of the adaptor member preferably includes indexing or positioning points. The indexing or positioning points may be formed as a plurality of female attachment points embodied as slotted recesses that line a top portion of the adaptor member that may be selectively engaged with male attachment points on a flap member of the adjustable flap when the adaptor member and the flap member are engaged with one another as described below.

More specifically, the adaptor member preferably includes an extension member at its lower portion, and the flap member preferably includes a slotted aperture at its lower portion. The extension member may be received within the slotted aperture, and subsequently rotated to couple the adaptor member and the flap member to one another. When the adaptor member and the flap member are selectively engaged by the aforementioned extension member and slotted aperture connection, the flap member may be able to rotate about the adaptor member.

As provided above, the flap member may include a plurality of male attachment points that align with the female attachment points of the adaptor member when the flap member and the adaptor member are engaged with one another. Because there are a plurality of male and female attachment points that may engage with one another, there is a range of relative positions that the adaptor member and flap member may take relative to one another depending on the number of engaged attachment points.

In at least one embodiment, a first male attachment point of the flap member may be longer than the rest of the male attachment points, and the last several female attachment points of the adaptor member may be longer than the rest of the female attachment points. That way, the flap member must be rotated to a certain degree to engage the longer male attachment member to one of the longer female attachment points. That way, the minimum degree to which the flap member should be rotated to provide sufficient protection may be reached, and the flap member may further be sufficiently stable relative to the adaptor member.

It should be noted that the adjustable jaw flap disclosed herein may be suitable for either right or left handed batters. The drawings that are shown and described in detail hereinbelow are configured for a right handed batter's jaw flap (a batter's left jaw facing the pitcher), but a left handed batter's jaw flap is preferably simply a mirror image of the jaw flap disclosed and described below.

DESCRIPTION OF THE DRAWINGS

For a better understanding of the various embodiments of the present invention, reference may be made to the accompanying drawings in which.

Figure 1A:
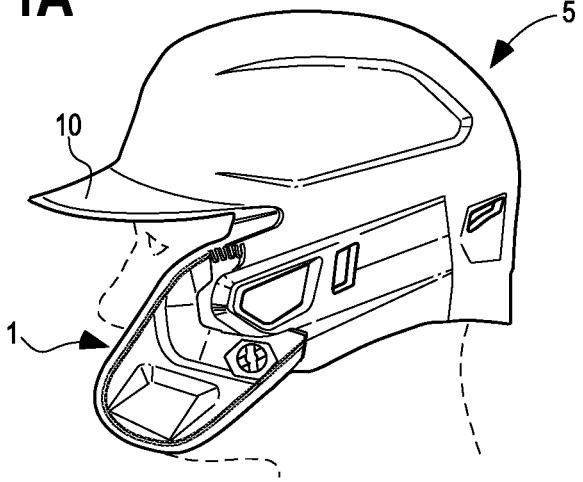
FIG. 1A is an elevation view of an adjustable helmet jaw flap constructed according to the teachings of the present invention in a first position relative to a batter's helmet.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 1B:
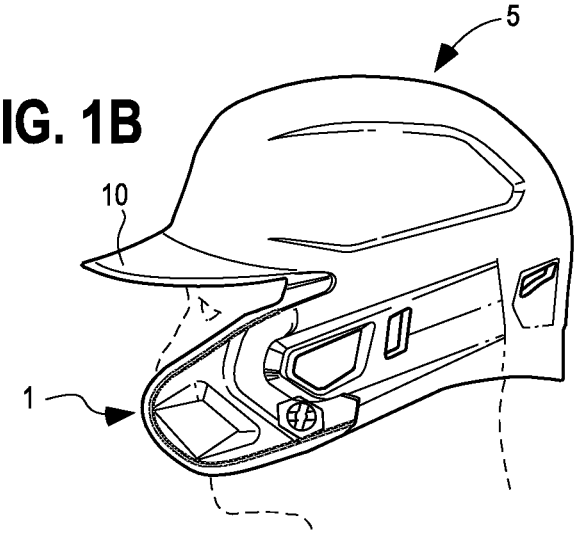
FIG. 1B is an elevation view of the adjustable helmet jaw flap of FIG. 1A in a second position.
Figure 1C:
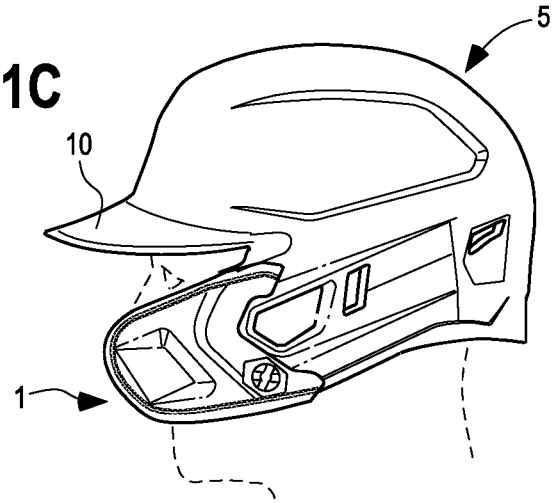
FIG. 1C is an elevation view of the adjustable helmet jaw flap of FIGS. 1A and 1B in a third position.

Turning first to FIGS. 1A-1C, an adjustable helmet jaw flap 1 used to protect a batter's face from pitched, batted, or thrown balls is selectively attached to a helmet 5. As will be described in greater detail herein below, the jaw flap 1 is made up of a number of components that allow it to rotate relative to the helmet 5 into a number of positions.

In FIG. 1A, the flap 1 is in a lowered position where the flap 1 points substantially downwardly, and the batter's upper neck and throat area is more concealed, and the space between the flap 1 and a visor 10 of the helmet 5 is greater. In FIG. 1B, the flap 1 is in an intermediate position where the flap 1 is in substantial alignment with a batter's jawline. FIG. 1C provides an example of the jaw flap 1 in a raised position, where the space between the flap 1 and the visor 10 is smaller than in FIGS. 1A and 1B. In this raised position, the batter's face area is more protected, but the neck and throat area is less protected. The jaw flap 1 may take on a wide range of positions between those illustrated in FIGS. 1A-1C, 2A and 2B, as will be described below, to allow for batters to position the flap 1 on the helmet 5 at a preferred location.

Figure 2A:
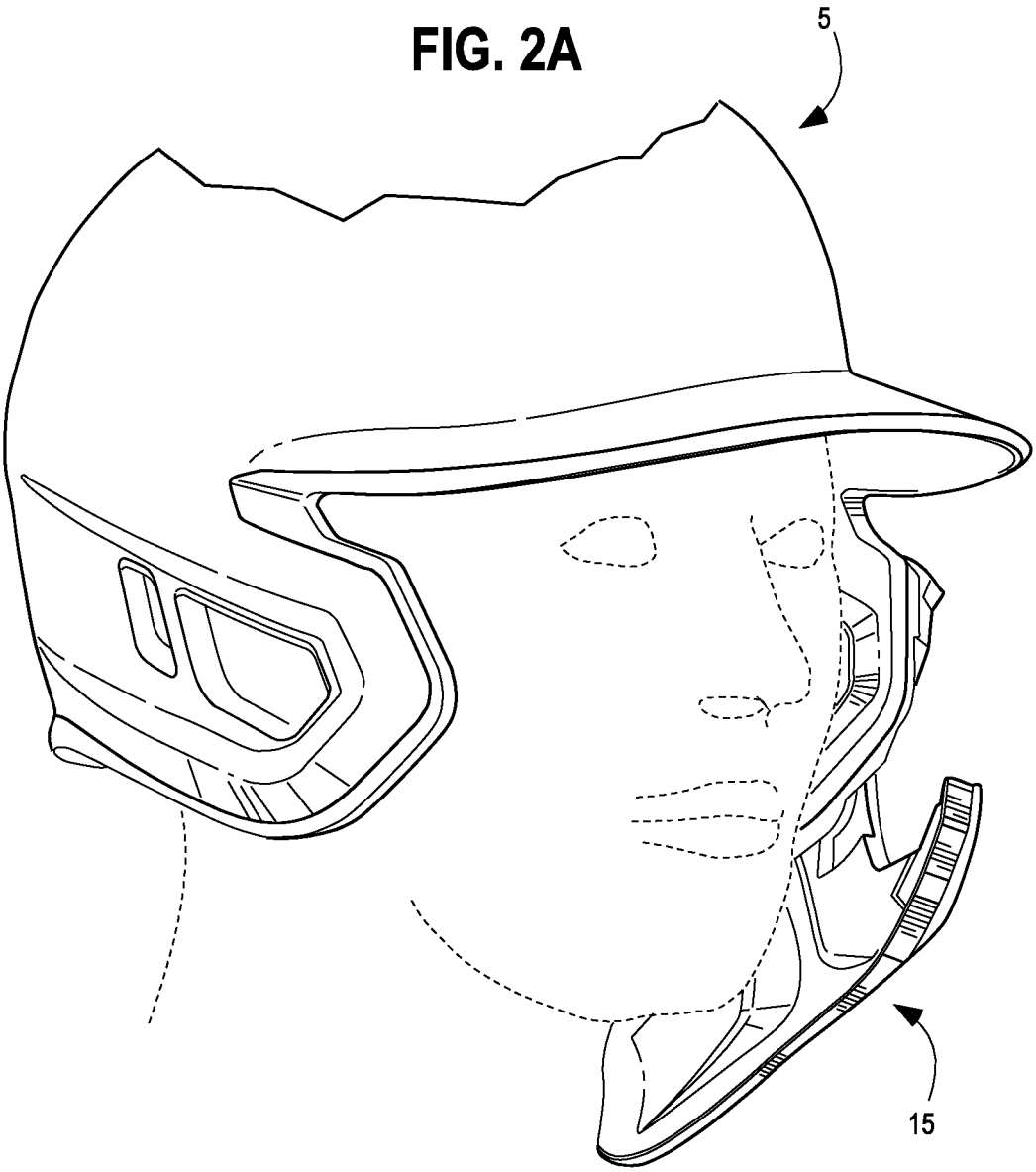
FIG. 2A is a first perspective view of an adapter member and a flap member of the adjustable helmet flap of FIGS. 1A-1C.
Figure 2B:
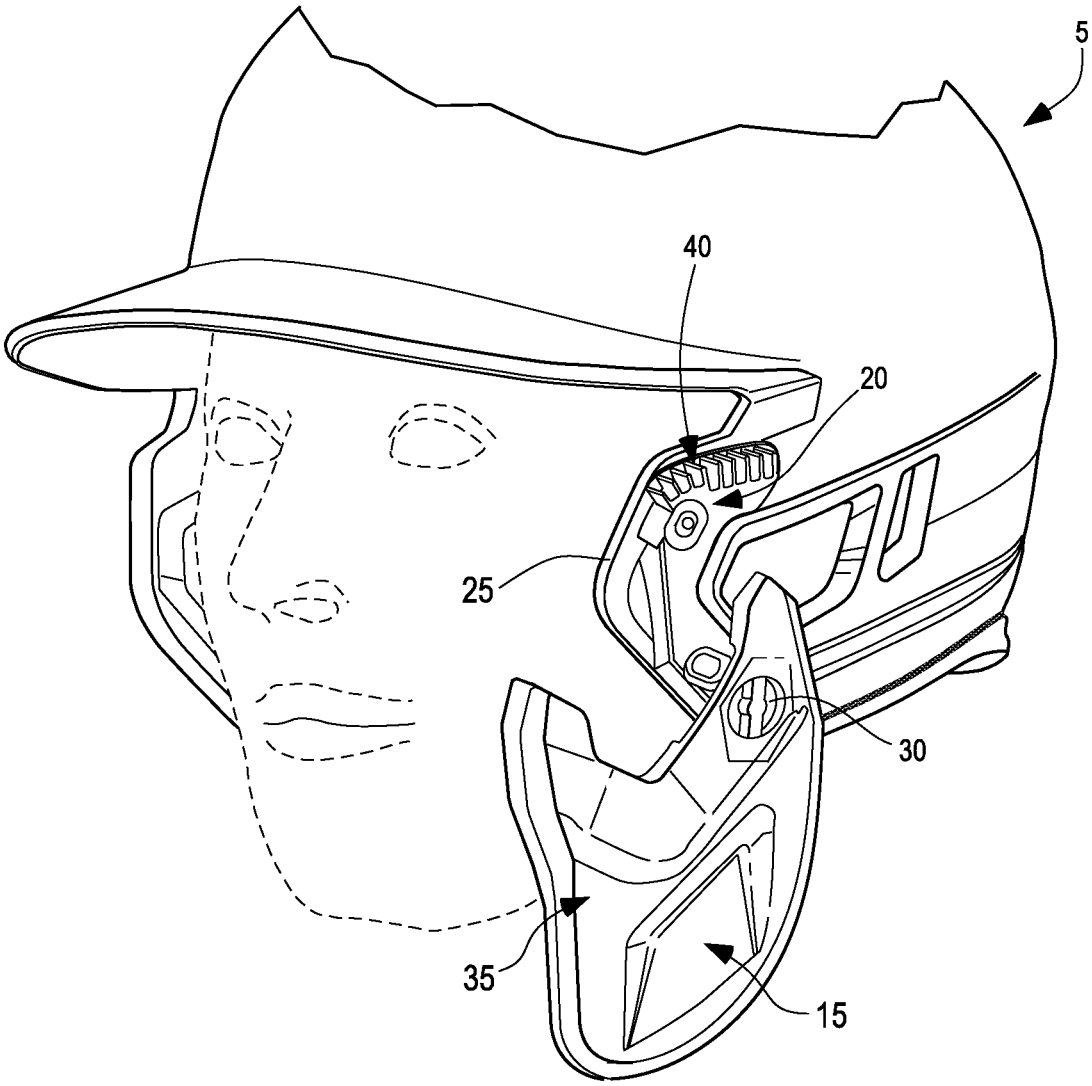
FIG. 2B is a second perspective view of the adapter member and the flap member of the adjustable helmet flap of FIG. 2A.

Turning to FIGS. 2A 2B, a flap member 15 is shown partially coupled to the helmet 5. Specifically, the flap member 15 is coupled to an adaptor member 20, which is coupled to an earflap 25 of the helmet 5. The flap member 15 and the adaptor member 20 are preferably coupled to one another by an extension member 30 of the adaptor member 20 that is received within a slotted aperture (described below) in the flap member 15 and subsequently rotated to secure the flap member 15 and adaptor member 20 to one another. In alternative embodiments, the flap member 15 and the adaptor member 15 may be riveted or otherwise fastened to one another. When the adaptor member 15 and the flap member 20 are coupled to one another via the extension member 30, an upper portion 35 of the flap member 15 may be rotated upwardly to further engage the adaptor member 20 at an upper portion 40 of the adaptor member 20. When the upper portions 35, 40 are engaged with one another in the manner described below, the jaw flap 1 may be adjustably rotated to take on the positions illustrated in FIGS. 1A, 1B and 1C (and other positions between those illustrated).

Figure 3:
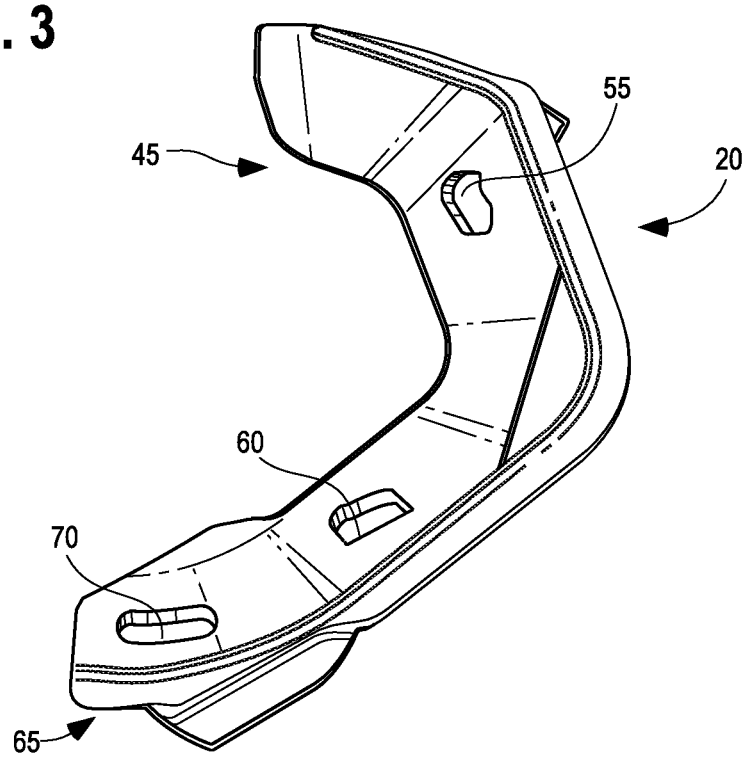
FIG. 3 is a rear elevation view of the adapter member of FIGS. 2A and 2B.
Figure 4:
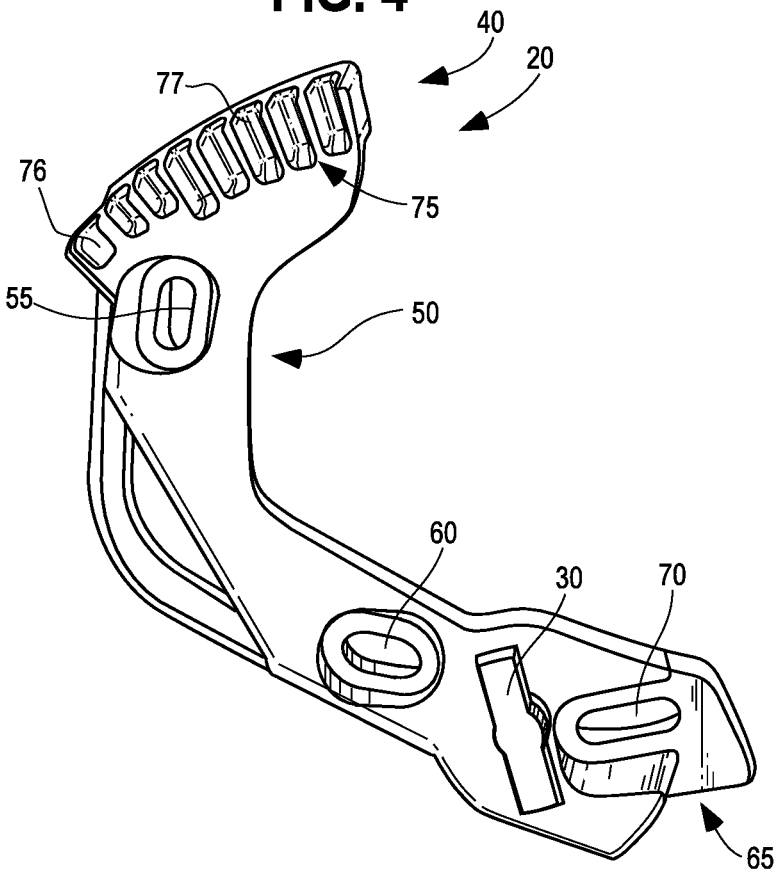
FIG. 4 is a front elevation view of the adapter member of FIGS. 2A and 2B, and FIG. 3.

Turning to FIGS. 3 and 4, the adaptor member 20 is illustrated in greater detail. FIG. 3 illustrates an interior side 45 of the adaptor member 40 that abuts the earflap 25 of the helmet 5 when attached thereto, while FIG. 4 shows an exterior side 50 of the adaptor member 40 that abuts the flap member 15 when attached thereto. The adaptor member 40 in FIGS. 3 and 4 is preferably shaped in a "C-shape" to conform with the earflap 25, but in alternative embodiments, it may take on a number of shapes that still allow it to be coupled with each of the earflap 25 and the flap member 15.

The adaptor member 20 preferably includes each of a first aperture 55 and a second aperture 60. As shown, the first aperture 55 is positioned above the second aperture 60. At a lower portion 65 of the adaptor member 20, an additional circular aperture 70 is also preferably provided. The apertures 55, 60, 70 preferably extend through the interior portion 45 and the exterior portion 50 of the adaptor member 20, and as a result are illustrated in both of FIGS. 3 and 4. When the adaptor member 20 is positioned such that its exterior portion 50 is facing outwardly and away from an earflap such as the earflap 25, the apertures 55, 60, 70 preferably align with attachment points associated with the earflap 25 (not illustrated). Such attachment points are receivable within the apertures 55, 60, 70. When the attachment points are received within the apertures 55, 60, 70 such that they protrude therefrom, a cap, bolt, or other attachment piece may be used to secure the adaptor member 20 to the earflap 25 via the attachment points protruding through the apertures 55, 60, 70. In alternative embodiments where the adaptor member 20 is configured to be compatible with alternatively constructed batters' helmets, the apertures 55, 60, 70 may be located elsewhere on the adaptor member 20, or there may be fewer or more apertures.

At the lower portion 65 of the adaptor member 20, the extension member 30 is illustrated. The extension member 30 may align with a slotted aperture described below of the flap member 15 and through which the extension member 30 may be inserted. As described above and as will be explored in greater detail below, the flap member 15 may rotate relative to the adaptor member 20 by rotating about the extension member 30 that is received and extends through the slotted aperture of the flap member 15 described below.

The exterior side 50 of the adaptor member 20 is preferably provided with a plurality of female attachment points 75 along its upper portion 40. The female attachment points 75 are preferably provided as elongate, slot-shaped cavities, though in alternative embodiments may be provided as different shapes with which male attachment points associated with the flap member 15 (described below) may be compatible.

Preferably, the adaptor member 20 includes two sizes of female attachment points 75, first female attachment points 76 and second female attachment points 77. The first female attachment points 76 may be shorter than the second female attachment points 77 such that they do not extend as far downwardly toward the lower portion 65 of the adaptor member 20. As described below, the different sizes that the female attachment points 75 take on may act to ensure that the flap member 15 and the adaptor member 20 are sufficiently attached to one another to maintain structural integrity and/or provide sufficient coverage to protect the face of a wearer. In the illustrated embodiment, there are three first female attachment points 76 and five second female attachment points 77, though in alternative embodiments the ratio of first female attachment points 76 and second female attachment points 77 may vary. In yet another embodiment, the female attachment points 75 may all be substantially the same size and shape.

Figure 5:
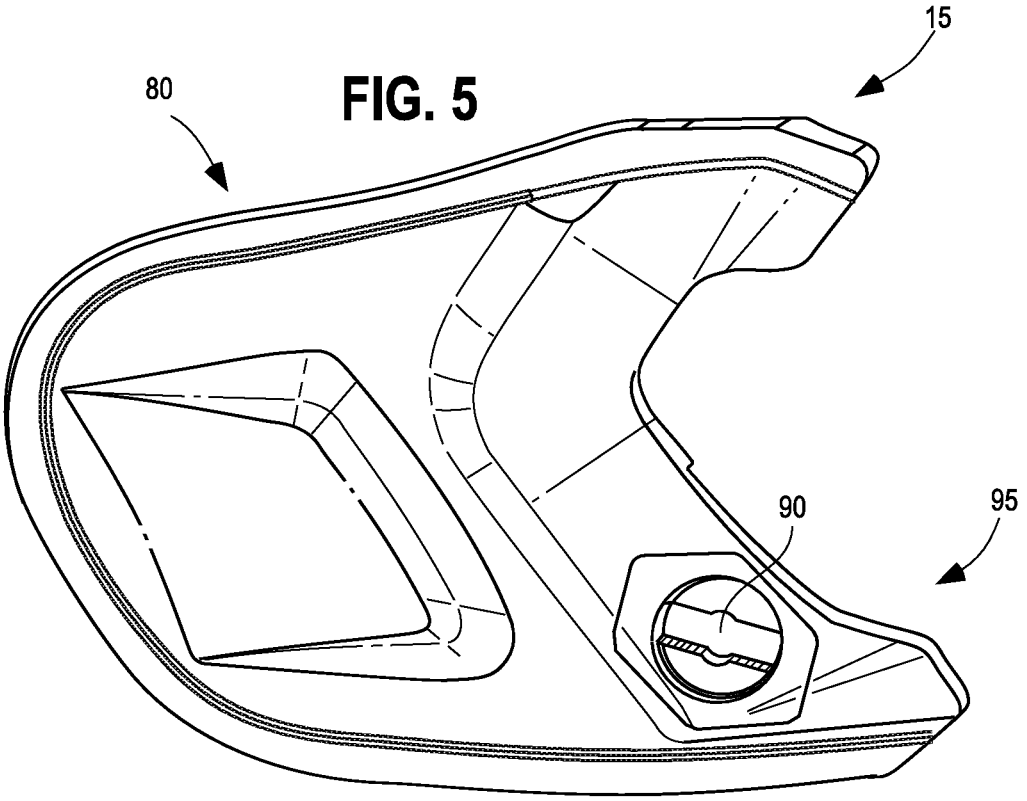
FIG. 5 is a front plan view of the flap member of FIGS. 2A and 2B.
Figure 6:
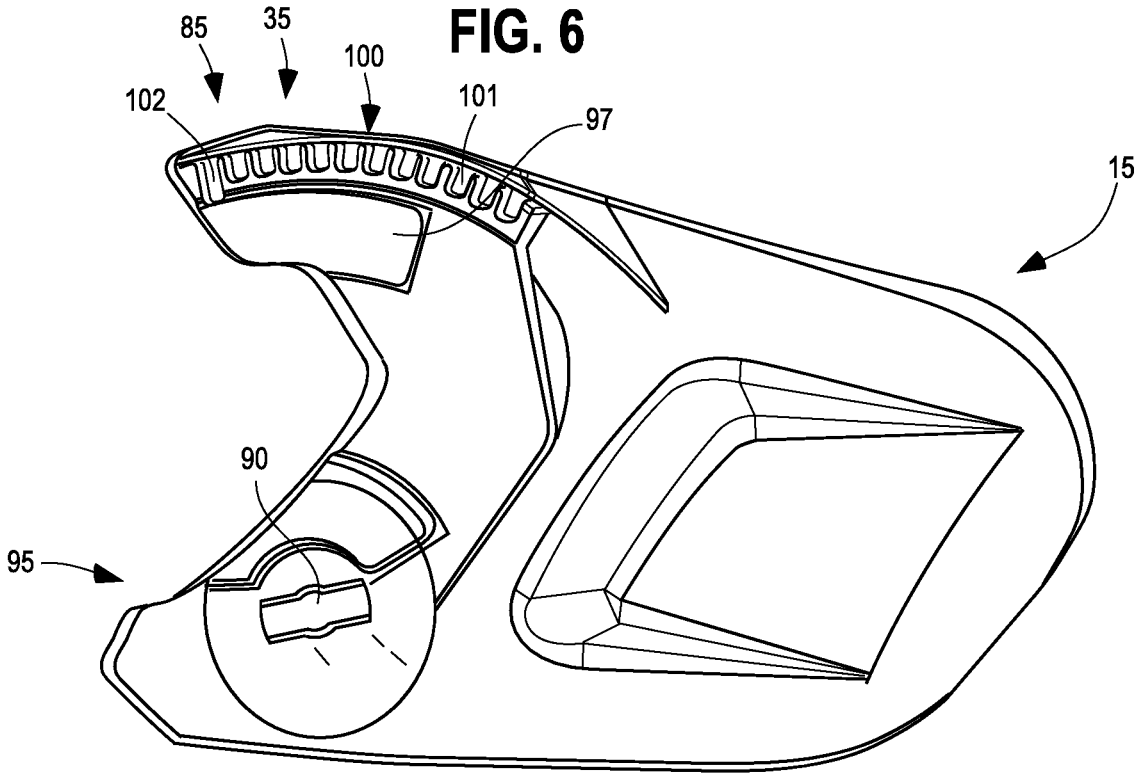
FIG. 6 is a rear plan view of the flap member of FIGS. 2A and 2B, and FIG. 5.

The flap member 15 is further illustrated in greater detail in FIGS. 5 and 6. More particularly, an exterior side 80 of the flap member 15 is illustrated in FIG. 5, and an interior side 85 of the flap member 15 as illustrated in FIG. 6. On both of the exterior side 80 and the interior side 85, a slotted aperture 90 is preferably provided at a lower portion 95 of the flap member 15. As described above, the slotted aperture 90 may be sized and shaped only slightly larger than the extension member 30 of the adaptor member 20 such that when the extension member 30 and the slotted aperture 90 are aligned, the extension member 30 may extend through the slotted aperture 90. After the extension member 30 has been placed through the slotted aperture 90, the flap member 15 may be rotated relative to the adaptor member 20 so that the extension member 30 no longer aligns with the slotted aperture 90, and the flap member 15 and the adaptor member 20 are releasably coupled to one another. With the flap member 15 and the adaptor member 20 coupled to one another, the flap member 15 should still be able to rotate freely relative to the adaptor member 20, as illustrated in FIGS. 1A, 1B, and 1C.

In some embodiments, but not all embodiments, the upper portion 35 of the interior side 85 of the flap member 15 may include a channel member 97. The channel member 97 preferably extend in a curvilinear path that is preferably in line with a bolt or other fasting means described above used to attach the adaptor member 20 to the helmet 5 via the aperture 55. That way when the flap 1 is rotated, the bolt may be received and guided within the channel member 97 to reduce the likelihood of damage to the flap member 15.

Also at the upper portion 35 of the interior side 85 of the flap member 15, a plurality of male attachment points 100 are preferably provided that may be selectively attached to the female attachment points 75 of the adaptor member 20. There may be two sizes of male attachment points 100, first male attachment points 101 and a second male attachment point 102. The first male attachment points 101 are preferably be shorter than the second male attachment point 102 such that they do not extend as far downwardly toward the lower portion 95 of the flap member 15. In a preferred embodiment, the first male attachment points 101 are preferably formed as protrusions having a shape substantially similar to, but a size just smaller than that of the first female attachment points 76. Similarly, the second male attachment point 102 is preferably formed as a protrusion having a shape substantially similar to, but a size just smaller than that of the second female attachment points 77. That way, when a first male attachment point 101 is aligned with a first female attachment point 76, or the second male attachment point 102 is aligned within a second female attachment point 77, it may firmly be received and engaged therein.

Figure 7:
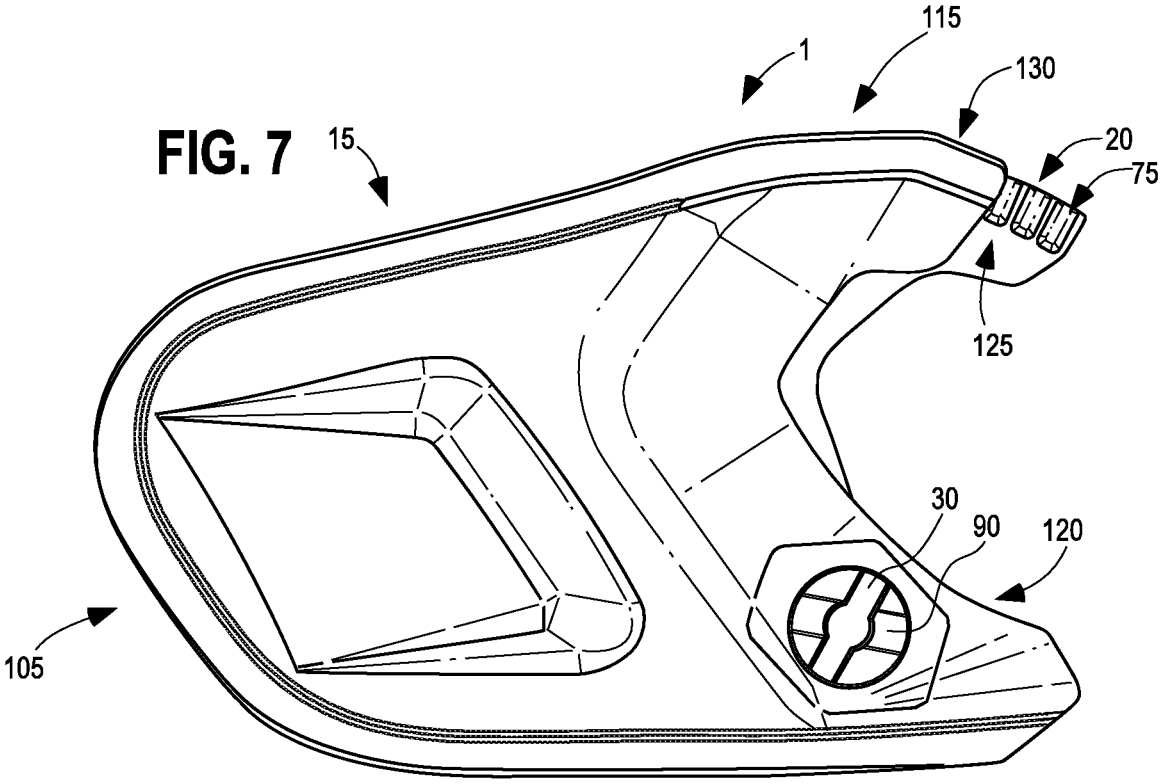
FIG. 7 is a front plan view of the adjustable jaw helmet flap in an extended position.
Figure 8:
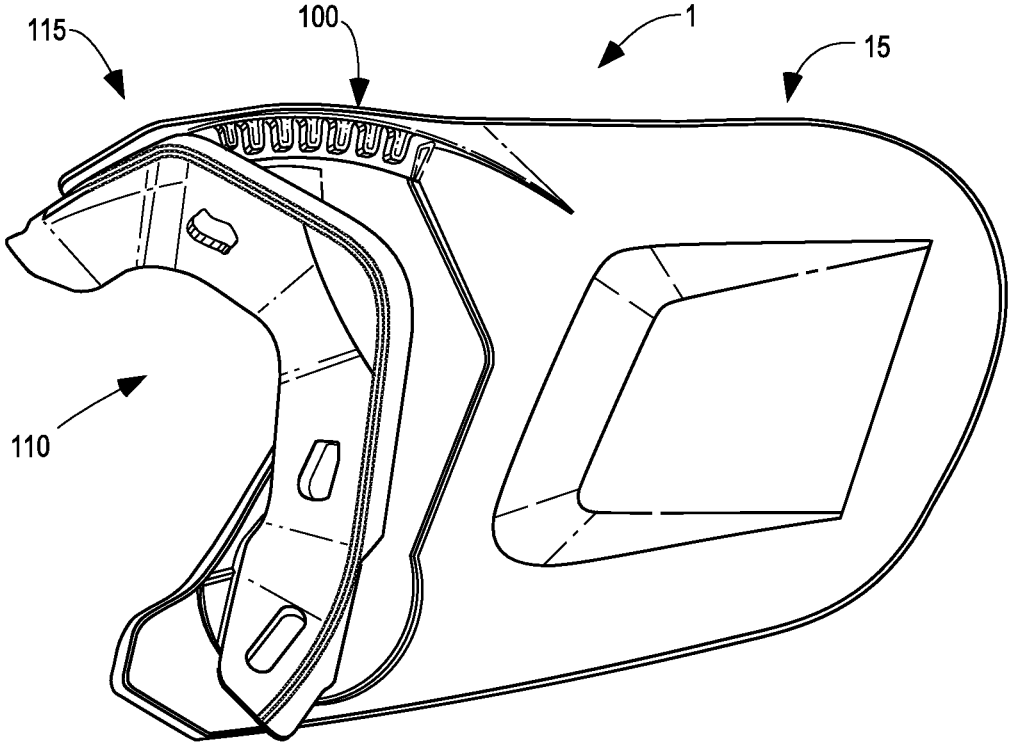
FIG. 8 is a rear plan view of the adjustable jaw helmet flap in an extended position.

Turning to FIGS. 7 and 8, the flap member 15 and the adaptor member 20 are shown as attached to one another so as to form the jaw flap 1. More particularly, FIG. 7 illustrates an exterior side 105 of the jaw flap 1 while FIG. 8 illustrates an interior side 110 of the jaw flap 1. The exterior side 105 of the jaw flap 1 is the side of the jaw flap 1 that would face a pitcher when a batter is batting, while the interior side 110 of the jaw flap 1 would face the batter's cheek when the batter is batting. In the embodiments illustrated in FIGS. 7 and 8, the flap member 15 and the adaptor member 20 are selectively attached to one another at an upper portion 115 by the engagement of the female attachment points 75 and the male attachment points 100.

Notably, the flap member 15 has been sufficiently rotated such that the second male attachment point 102 has rotated beyond the first female attachment points 76 for which it is too long to securely fit. Instead, the second male attachment point has rotated to at least the second female attachment point 77, where it may be securely retained therein. By providing the first several first female attachment points 76 that the second male attachment point 102 will not securely fit, in the illustrated embodiment, the jaw flap 1 includes a safeguard to alert the user that the flap member 15 has been rotated enough to provide sufficient coverage for his or her face and also has overlapped enough with the adaptor member 20 to have sufficient structural integrity.

Near a lower portion 120 of the jaw flap 1, the flap member 15 and the adaptor member 20 are attached to one another by the extension member 30 having been received through the slotted aperture 90 and subsequently rotated. In this position (ignoring for illustrative purposes the attachment of the female attachment points 75 and male attachment points 100), the flap member 15 may rotate freely about the adaptor member 20.

In FIGS. 7 and 8, the jaw flap 1 is shown in an extended position similar to that shown in FIG. 1A. More particularly, the flap member 15 is rotated outwardly relative to the adaptor member 20 such that the second male attachment point 102 has rotated sufficiently to be received by one of the second female attachment points 77 nearer the first female attachment points 76, but it has not been fully rotated, either (not illustrated because the attached first, and other, attachment points are covered by the flap member 15 in FIG. 7 and the adaptor member 20 in FIG. 8). In such a position, many of the attachment points 75, 100 are left unengaged with one another, and thus are visible in the example embodiments illustrated in FIGS. 7 and 8.

Figure 9:
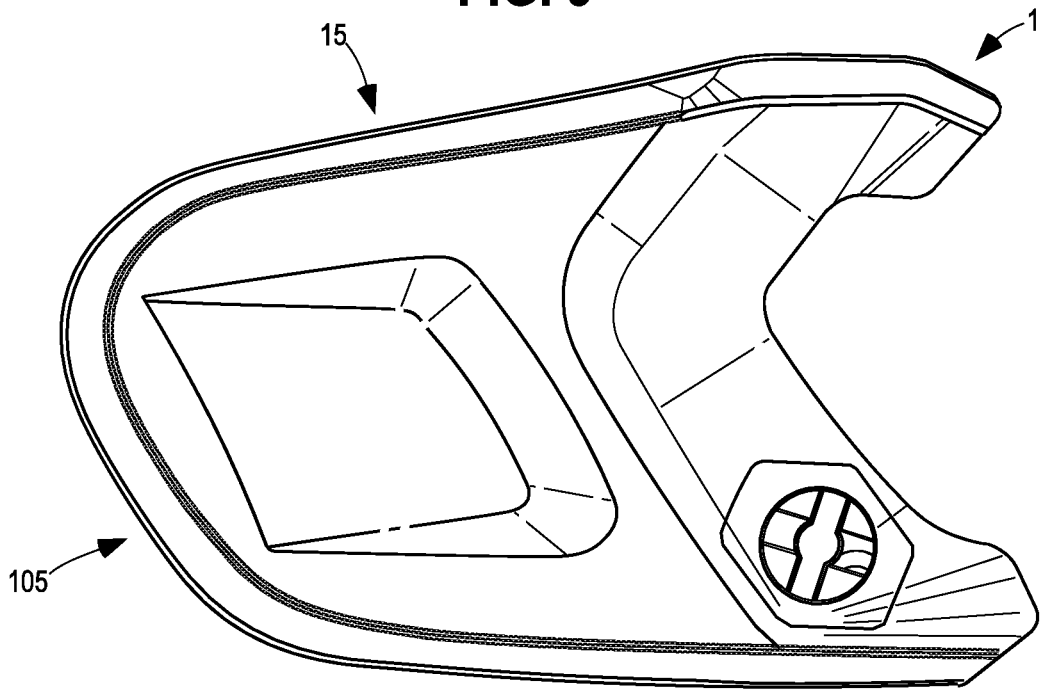
FIG. 9 is a front plan view of the adjustable jaw helmet flap in a contracted position.
Figure 10:
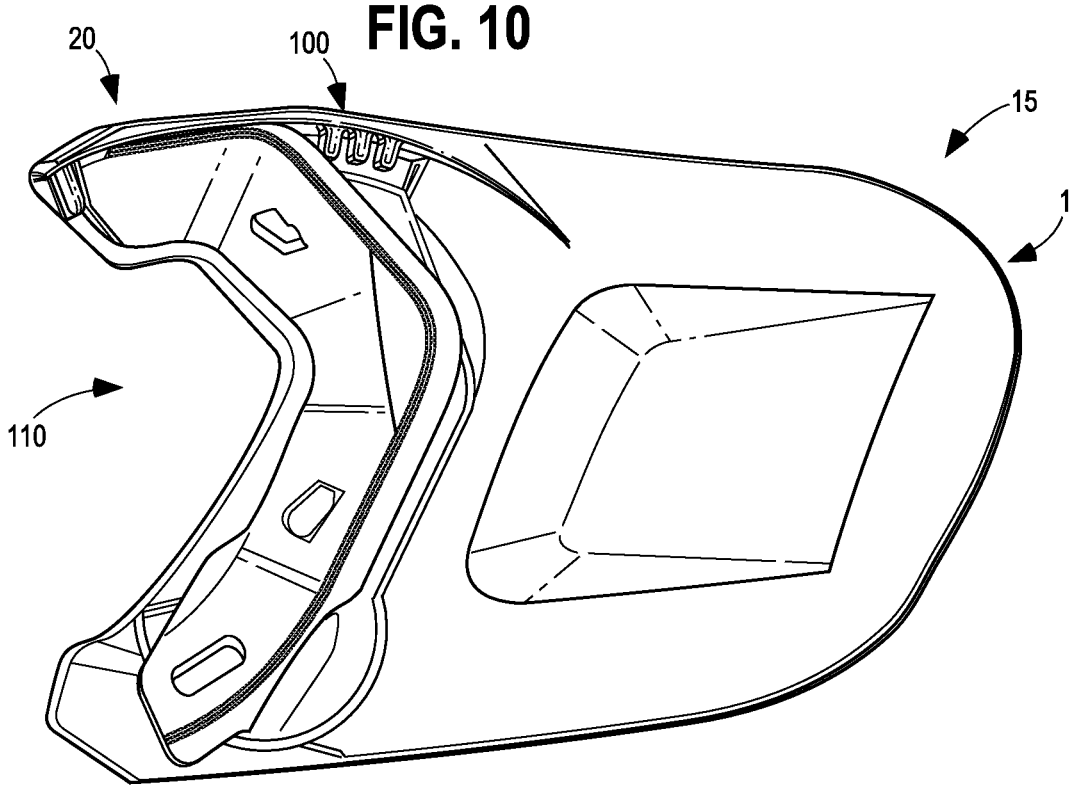
FIG. 10 is a rear plan view of the adjustable jaw helmet flap in a contracted position.

When a user wishes to raise the jaw flap 1 to be in a position more similar to that illustrated in FIG. 1C, he or she should rotate the flap member 15 relative to the adaptor member 20 such that more attachment points 75, 100 may be engaged with one another. Such an embodiment, where the flap member 15 has been rotated relative to the adaptor member 20 to contract the jaw flap 1, is illustrated in FIGS. 9 and 10.

In its raised position, the flap member 15 has preferably been rotated rearwardly so that additional attachment points 75, 100, engage one another. As such, in the examples illustrated in FIGS. 9 and 10 of the exterior side 105 of the jaw flap 1 and the interior side 110 of the jaw flap 1 only a few of the attachment points, 75, 100 are illustrated. That is because in the embodiments illustrated in FIGS. 9 and 10, the flap member 15 is nearly completely rotated relative to the adaptor member 20 such that nearly all attachment points 75, 100 are engaged with one another and thus obstructed from view.

As would be understood by those skilled in the art, while the embodiments in FIGS. 7-10 show the jaw flap 1 in only two positions, there are a number of positions between (and beyond) those shown in FIGS. 7 & 8 and FIGS. 9 and 10 wherein a variety of attachment points 75, 100 are selectively attached with one another. As such, a batter may rotate the flap member 15 relative to the adaptor member 20 to a preferred position. He or she simply may do so by changing the number of attachment points 75, 100 that are engaged with one another.

It should be noted that the adjustable jaw flap 1 described above suitable for either right or left handed batters. The drawings that are shown and described in detail above are configured for a right handed batter's jaw flap (a batter's left jaw facing the pitcher), but a left handed batter's jaw flap is preferably simply a mirror image of the jaw flap 1 disclosed and described below.

While a number of alternative embodiments are contemplated herein, in one alternative embodiment, the attachment points 75, 100 may be absent. In that embodiment, the adaptor member 20 and the flap member 15 may be attached to one another at a lower portion by the extension member 30. However, in this illustrative (but non-limiting) example embodiment, the upper portions of the adaptor member 20 and the flap member 15 are not attached to one another. Instead, they are provided with guiding mechanisms that allow the adaptor member 20 and flap member 15 to rotate relative to one another (without being attached to one another). For example, the exterior portion of the adaptor member 20 may include a channel that guides a protrusion of the interior of the flap member 15 along a path that replicates the path that the flap member 15 takes when it is rotated relative to the adaptor member 20. In such an embodiment, the protrusion is preferably snugly fit within the channel so that after the flap member 15 is rotated, it firmly stays in place.

In at least one alternative embodiment, the structure described above as the adaptor member 20 may be integrally formed with the batter's helmet so that including the adaptor member 20 is unnecessary and the flap member 15 is directly attachable to the helmet 5. In such an embodiment, the flap member 15 may be attached to the helmet 5 in a manner substantially similar as described above for the adaptor member 20, or it may be attached in an altogether different way. Any method for attachment is foreseeable that uses known or foreseeable attachment means that allows the flap member 15 to rotate about the helmet 5 to allow a batter to better control the location of the flap member 15 relative to his or her face.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An adjustable jaw flap for selective engagement with a batter's helmet, the adjustable jaw flap including:

an adaptor member that has a first side and a second side, wherein the first side of the adaptor member is selectively attachable with the batter's helmet;

a flap member that has a first side and a second side wherein the first side of the flap member is selectively attachable to the second side of the adaptor member;

wherein the flap member is rotatable in at least one axis relative to the adaptor member;

wherein the second side of the adaptor member includes a plurality of indexing points, and the first side of the flap member includes a plurality of indexing points that are selectively attachable to the indexing points of the second side of the adaptor member; and wherein there are at least two sizes of indexing points for each of the indexing points of the adaptor member and the flap member.

2. The adjustable jaw flap of claim 1, wherein the indexing points of the adaptor member are one of male and female attachment points, and the indexing points of the flap member are the other of male and female attachment points.

3. The adjustable jaw flap of claim 1, wherein the second side of the adaptor member includes an extension member that projects outwardly therefrom, and the first side of the flap member includes a slotted aperture through which the extension member is received.

4. The adjustable jaw flap of claim 1, wherein the adaptor member includes one or more holes that are used to attach the adaptor member to the batter's helmet.

5. An adjustable jaw flap for selective engagement with a batter's helmet, the adjustable jaw flap including:

an adaptor member that has a first side and a second side, wherein the first side of the adaptor member is selectively attachable with the batter's helmet, and the second side of the adaptor member includes a plurality of indexing points;

a flap member that has a first side and a second side wherein the first side of the flap member is selectively attachable to the second side of the adaptor member, and the first side of the flap member includes a plurality of indexing points that are engageable with the indexing points of the adaptor member;

wherein when the flap member is rotated relative to the adaptor member, more or fewer indexing points of the adaptor member and the flap member are engaged with one another; and wherein there are at least two sizes of indexing points for each of the indexing points of the adaptor member and the flap member.

6. The adjustable jaw flap of claim 5, wherein the indexing points of the adaptor member are one of male and female attachment points, and the indexing points of the flap member are the other of male and female attachment points.

7. The adjustable jaw flap of claim 5, wherein at least one first indexing points and at least one second indexing points of the adaptor member are configured to mate with at least one first indexing points and at least one second indexing points of the flap member, respectively.

8. The adjustable jaw flap of claim 5, wherein the second side of the adaptor member includes an extension member that projects outwardly therefrom, and the first side of the flap member includes a slotted aperture through which the extension member is received.

9. The adjustable jaw flap of claim 5, wherein the adaptor member includes one or more holes that are used to attach the adaptor member to the batter's helmet.

* * * * *